United States Patent [19]

Mims, Sr.

[11] Patent Number: 4,983,105

[45] Date of Patent: Jan. 8, 1991

[54] DOWN HOLE PUMP

[76] Inventor: Joe L. Mims, Sr., 5015 16th St., Lubbock, Tex. 79416

[21] Appl. No.: 332,783

[22] Filed: May 25, 1989

[51] Int. Cl.[5] ..... F04B 21/04; F16J 9/08

[52] U.S. Cl. ..... 417/554; 92/247

[58] Field of Search ..... 92/247, 201; 417/545, 417/552, 553, 554

[56] References Cited

U.S. PATENT DOCUMENTS

| | | | |
|---|---|---|---|
| 616,308 | 12/1898 | Forsyth et al. | 417/554 |
| 680,565 | 8/1901 | Clinger | 417/552 |
| 1,116,467 | 11/1914 | Myers | 417/545 |
| 1,495,807 | 5/1924 | Sanders | 417/552 |
| 2,336,803 | 5/1942 | Pratt | 417/554 |
| 3,536,424 | 12/1968 | Plos | 417/545 |
| 4,531,891 | 6/1985 | Coles | 92/247 |
| 4,762,476 | 11/1988 | Turner | 417/554 |

FOREIGN PATENT DOCUMENTS

| | | | |
|---|---|---|---|
| 22617 | 11/1917 | Denmark | 417/552 |
| 611076 | 10/1960 | Italy | 417/552 |

*Primary Examiner*—Leonard E. Smith
*Assistant Examiner*—John A. Savio, III

[57] ABSTRACT

My invention is a down hole pump that operates on hydrostatic pressure. The mandrel is a tubular member having perforations therein. The expandable tube made of high quality plastic surrounds the hollow mandrel covering the perforations, thereby forming a means for communicating hydrostatic pressure existing within said hollow mandrel on an upstroke of said pump to expand the expandable tube. There is a plurality of special expandable rings which surround the expandable tube. The expandable tube causes the rings to expand radially with the expandable tube so as to maintain constant contact with the barrel. There is also a plurality of expandable spacers surrounding the expandable tube between each of the expandable rings which have a significantly smaller outside diameter than the expandable rings. There are also means provided to secure the expandable tube, rings and spacers to the mandrel.

6 Claims, 3 Drawing Sheets

FIG-13
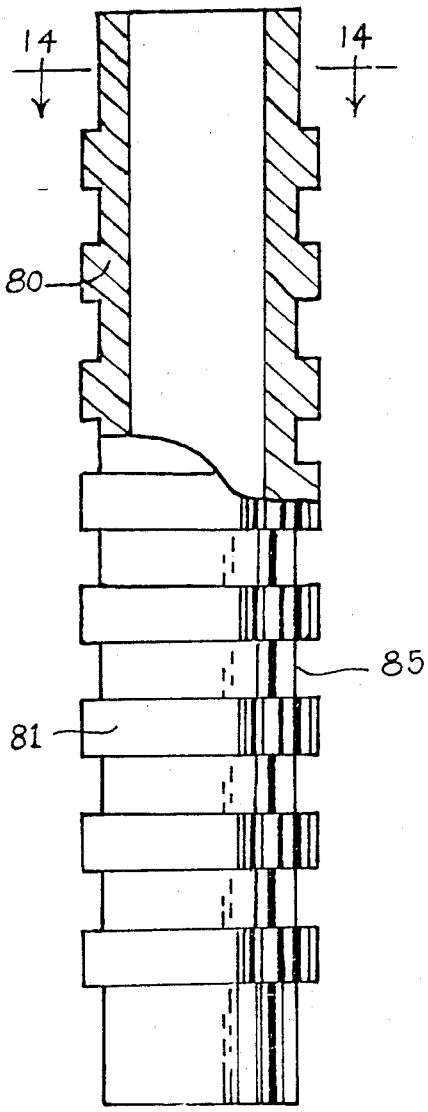
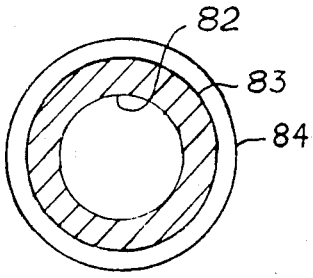
FIG-14

DOWN HOLE PUMP

BACKGROUND OF THE INVENTION

This new version of a downhole pump is designed to solve the problem of traditional downhole pumps having rigid rings. Producing oil wells are known for the problems associated with downhole pumps.

Downhole pumps in the prior art have always been inefficient because of the types of mandrels and rings used. Traditionally, most pumps use "rag" rings because they have been the most dependable to date, however some downhole pumps do use synthetic rings. In these present applications, the downhole pumps require extra long mandrels with extra rings to help create enough friction against the interior surface of the working barrel to lift fluid to the top of the well. The pump rings are rigid, therefore, when the rings become grooved or worn, they become ineffective. Workers, known in the oil fields as pulling unit crews, work with special motorized units, called pulling units, to remove worn pumps from the well and replace them with a new one. This procedure can require hours and even days before the pumping unit can being to pump oil again. It is not unusual for a newly installed pump to work only a few days before the pulling operation has to be repeated.

Over a dozen inventions have attempted to solve this problem, dating back to Lewis in 1882, J. S. Thompson 1889, Kammerer 1912, Rhoder 1976, and Carrens 1982. R. L. Chenault, in 1942, invented a filter to try and keep sand out of the pumps.

Oil wells have a number of components and mechanisms that are utilized in the process of pumping oil to the surface. When the well is drilled, there is a series of pipes used. (1) The surface pipe is the largest, being ten to thirteen inches in diameter, and is only inserted a few hundred feet into the earth. (2) A long string of pipe, called the oil string, is inside the surface pipe and reaches down into the oil pay where it is cemented into place. A perforated section of pipe in the bottom lets the fluid into the long string. (3) Tubing is installed inside the oil string, and encases the sucker rods and the pump. (4) A pumping unit on the surface is connected to the sucker rods and reciprocates the pump to move oil through the tubing to the surface.

Because the pump is installed in the bottom of the well, sometimes thousands of feet below the surface, it becomes very costly to replace the pump. Therefore, any new, better, or more efficient pump would be well received by the producers of oil. It is anticipated that my new and improved downhole pump will fulfill these expectations.

SUMMARY OF THE INVENTION

My invention is a new, better, more versatile downhole pump, having an improved mandrel, expandable pressure tube, expandable compression rings (similar to automobile piston rings), expandable spacers, and special retainers to secure the special expandable pressure tube, rings, and spacers.

My new downhole pump utilizes the new expandable pressure tube, the expandable rings and spacers, and other components parts, in conjunction with hydrostatic pressure, as means to secure positive retroaction against the inner surface of a working barrel. An outward radial pressure created inside may newly designed mandrel (with perforations for a means of pressurizing the expandable tube) causes my newly designed rings and spacers to expand. Because of the expandable feature of the rings and spacers, a special tool (designed for the purpose) is used to compress the rings and spacers when this new pump is inserted into the working barrel.

Upon initial installation of the pump into the working barrel, the rings will have tension against the inner surface of the working barrel. As automobile piston rings "seats" after a period of operation, the rings on this new pump will also have a "seating" period. Unlike auto piston rings, which lose their ability to expand when they are worn down, my new pump having the expandable pressure tube will continue to expand may expandable rings indefinitely.

Realizing that other embodiments are used in conjunction with downhole pumps, such as balls and seats, cages, working barrels, seating nipples, sucker rods, etc., I lay no claim to such in may application. These embodiments will, however, be utilized in conjunction with my new pump when it is installed.

In the prior art, the installation of a new down hole pump consisted of all the embodiments mentioned above. The main embodiments are ball and seat, check valves, pump, and working barrel. The working barrel has a check valve in the bottom to control fluid entering the barrel.

Seating cups hold the working barrel stationary in the bottom of the tubing. Inside the working barrel is my newly designed pump, consisting of a special hollow, perforated mandrel, special pressure tube, expandable steel rings and spacers.

In prior arts, a cage connects sucker rods to the pump. My newly designed pump utilizes this cage to let fluid pass through the center of the mandrel on the down stroke. As the pump reciprocates, a check valve mounted on the bottom of the mandrel opens on the down stroke and, as mentioned above, the fluid passes through the center of the pump because the rings do not retract from the working barrel.

As the pump moves upward on the upstroke, the valve on the bottom of the mandrel closes, transforming the pump into a piston like embodiment. This reciprocating action serves a dual purpose. It pushes the fluid further up the tubing and in doing so, pulls fluid into the working barrel below the pump by creating a vacuum that opens the check valve on the bottom of the working-barrel.

As fluid rises inside the tubing, hydrostatic pressure is utilized to expand the pressure tube through means of the perforated mandrel. The check valve on the bottom of the mandrel being closed, the expandable steel rings maintain constant contact with the working barrel. This makes for positive displacement of fluid.

When the pump descends on the downstroke, the check valve on the bottom of the working barrel closes, and the check valve on the mandrel opens. Even though the hydrostatic pressure no longer expands the pressure tube, thereby releasing pressure on the expandable metal rings, they do not retract from the working barrel. There is sufficient pressure created on the down stroke to cause the pressure tube to keep residual pressure against the expandable rings. This action is repeated over and over as long as the pumping unit operates.

There are no mechanical devices such as springs, steel balls, detented plungers, slidable pads, tapered wedges, etc., inferred in my new pump. Only hydrostatic pressure is utilized to assist the operation of the special expandable pressure tube and the expandable rings and spacers, which is not anticipated in other patents that have been researched.

The expandable tube could also be made so as to include both the spacers and rings internally so that they comprise an assembly that is formed of piece.

BRIEF DESCRIPTION OF DRAWINGS

FIG. 13 is a side view of the integral expandable tube, ring and spacer unit.

FIG. 14 is a cross-sectional view of plane 14—14 as indicated by the sectional line in FIG. 13.

DETAILED DESCRIPTION OF PREFERRED EMBODIMENTS

Figure 1:
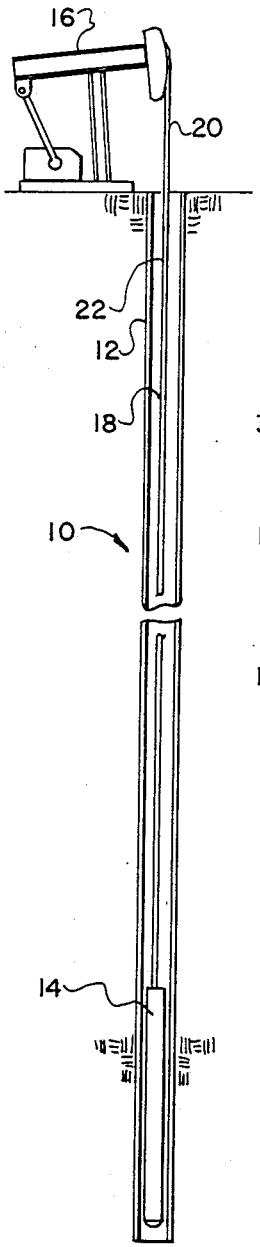
FIG. 1: Typically a producing oil well as seen if it were a cutaway in the earth.

FIG. 1: A cross-sectional of what an oil well might look like, nothing in detail, but in principal shows the main things involved in a reciprocating downhole pump. #16 is the pumping unit operated by electric motors or gas engines.

A cantilever beam #16 see-saws up and down causing the pump #14 to reciprocate up and down. #20 could be a "pony rod", a very short sucker rod that connects to the polished rod #22. #18 could be the "sucker rods" that are usually uniform in length and extend from top to bottom of the well, connecting onto the pump #14.

Figure 2:
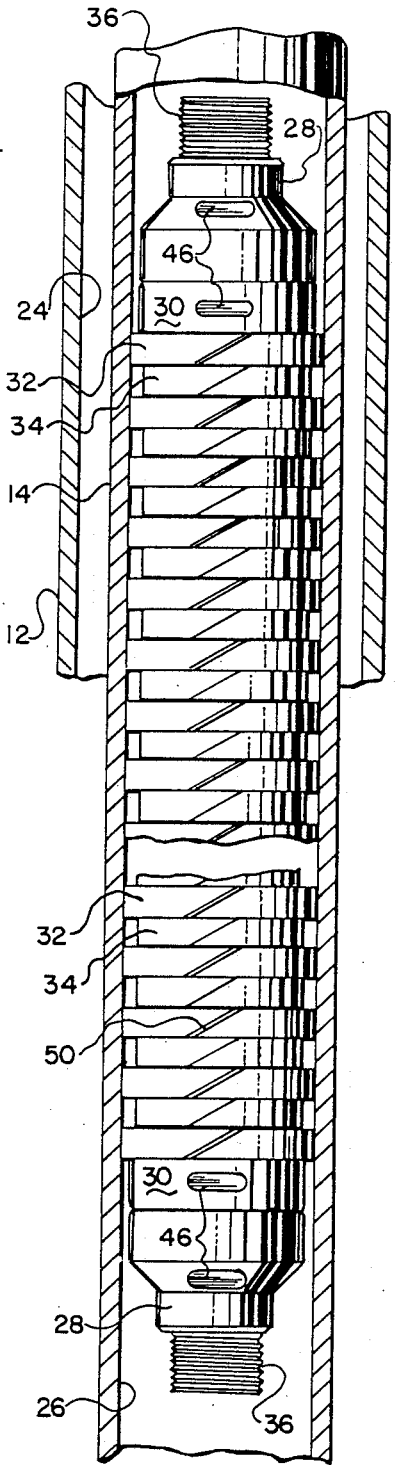
FIG. 2: Side view of downhole pump.

FIG. 2 is a side view of my newly designed pump installed inside a cutaway view of a working barrel #14. #36 is the specially designed mandrel that is hollow. Not visible in this view are the special threads and orifices; fluids pass through the center of the pump; this is the means whereby hydrostatic pressure expands the special pressure tube, which is not visible in this view. The adjusting nuts #28 and #30 can adjust the special expandable rings and spacers so that they will expand by means of the pressure tube. The rings and spacers must be able to expand freely. The nuts are locked together by frictionally tightening them with a wrench at slot #46.

#32 is the special expandable rings. Note that they are parted diagonally to insure a better seal when expanding. This also restricts any bypass of fluid.

The rings are similar to automobile piston rings, and seal against the working barrel at all times. #14 is the working barrel in which my new pump is installed. #34 are the spacers that separate the rings; they are also parted diagonally as the rings. The spacers are substantially smaller than the rings, providing a space that lubricating oils can accumulate.

The number of rings and spacers is determined by the length of pump that is required to lift the fluid. #12 is the outside surface of the tubing that encompasses the working barrel, and #24 is the inside surface of the same tubing. In between #24 and #14 is an annular space where fluids are gathered before the pump moves it to the top of the ground. #28 and #30 are the special nuts; they will be explained in FIG. 3. #50 is the diagonally cut ring. #26 is the inside surface of the working barrel #14.

Figure 3:
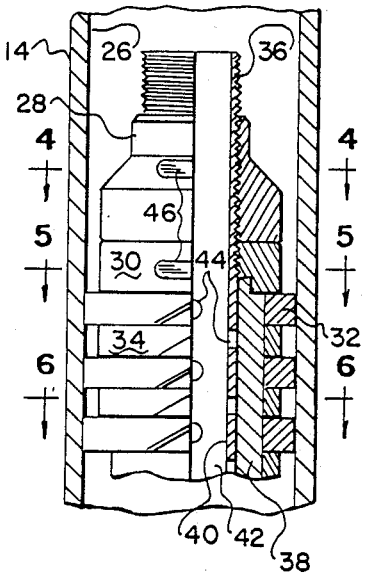
FIG. 3: Half sectional of upper section of pump.

FIG. 3 shows the top section of FIG. 2 with half-sectional of special pump. #14 is the outside surface of working barrel; #26 is the inside surface of the working barrel; #36 is the special threaded hollow mandrel showing extra threads where nuts #28 and #30 adjust to the rings, spacers, and the expandable pressure tube. #30 is counterbored to hold and seal the end of pressure tube #38. #44 indicates the orifices through which pressure expands the special expandable pressure tube #38 by hydrostatic pressure. #32 is a cutaway of a ring that is in contact with the working barrel #14 and the expandable tube #38. #40 is the inside surface of the mandrel indicating it is hollow. #34 is the special expandable spacer. #38 is the special expandable pressure tube.

Figure 4:
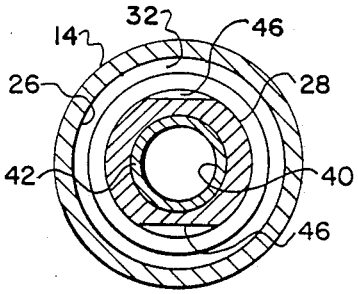
FIGS. 4–6: Cross-sectional views 4—4, 5—5, 6—6, through a plane indicated by these sectional lines in FIG. 3.

FIG. 4 is cross-sectional of FIG. 3 indicated at sectional plane 4—4. #14 is the working barrel and #26 is the inside surface of the barrel. #32 is the cutaway of the special expandable ring. #28 is one of the two special nuts. #30 is one of two specially counterbored nuts that holds and seals the ends of special expandable tube #38. Flats are cut on sides of nuts to facilitate wrenches at #46. #42 is the special mandrel. #44 indicates the orifices that are the means whereby pressure passes through to expand special tube #38. #40 is the inside surface of the mandrel showing that it is hollow, and that pressure passes through it and purges both the orifices and the pressure tube.

Figure 5:
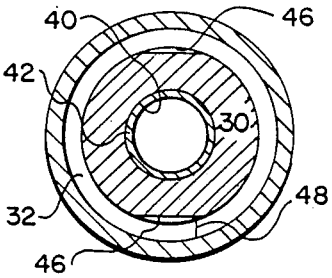

FIG. 5 is a cross-sectional of FIG. 3 above, indicated at sectional plane 5—5. #30 is cross section of special nut. #46 is the slot for wrench. #48 is indicating diagonal cut in ring #32. #42 is the threaded mandrel and #40 is the inside surface of mandrel.

Figure 6:
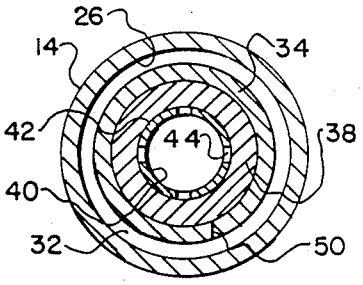

FIG. 6 is another cross-sectional of FIG. 3 as indicated at sectional plane 6—6. #44 is the orifices that facilitate the hydrostatic pressure to expand special pressure tube #38. #34 is cross-sectional of spacer, and #50 indicates the diagonal cut. #48 is special mandrel, and #40 indicates the inside surface. #14 is the working barrel and #26 is its inside surface.

Figure 7:
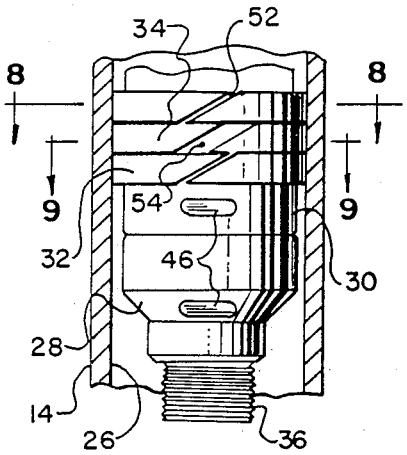
FIG. 7: Side view of lower section of pump.

FIG. 7 is the lower portion of FIG. 3. #52 is an exaggerated space of diagonally parted ring #32. #54 is also exaggerated gap in spacer #34. #14 is the working barrel and #26 is the inside surface of it. #28 and #30 are the special nuts. #30 is counterbored for the special tube, and #28 is the nut that locks #30 in place.

These two nuts are the same as those on the upper portion of FIG. 3. #36 is the threaded mandrel, and #32 is the expandable ring showing diagonal cut.

Figure 8:
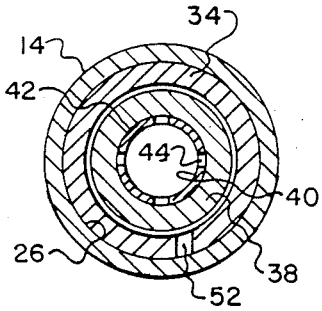
FIGS. 8–9: Cross-sectional views as indicated by planes at 8—8 and 9—9 in FIG. 7.

FIG. 8 is the cross-sectional of FIG. 7 as indicated at sectional plane 8—8. #34 is an expanded ring with gap exaggerated #52. #14 is outside surface of the working barrel, and #26 in the inside surface. #42 is the mandrel and #40 indicates inside surface of same. #44 is an orifice in the mandrel whereby pressure expands the special expandable pressure tube.

Figure 9:
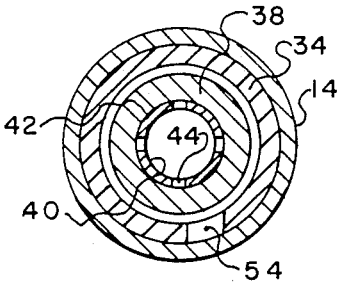

FIG. 9 is cross-sectional of FIG. 7 as indicated in sectional plane 9—9. #42 is the mandrel and #40 is inside surface of same. #44 indicates the orifices and are 90 degrees from those in FIG. 8. #54 is the exaggerated gap of spacer #34. #14 is the working barrel and #38 is the special expandable pressure tube.

Figure 10:
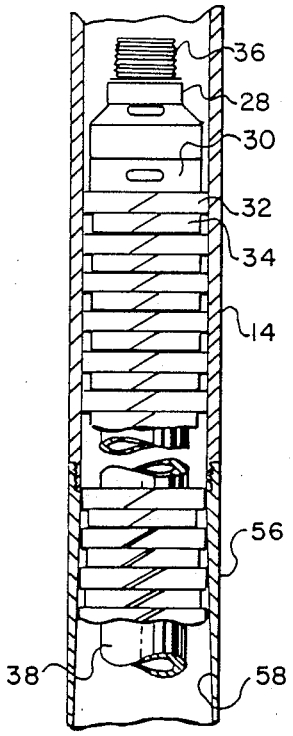
FIG. 10 is a parted side view of pump as installed with special tool. Upper section completely installed and lower portion still in tool. Rings are not compressed until they pass the threads of the working barrel.

FIG. 10 is a cross-sectional of a working barrel #14, with a parted pump inside. The upper portion of the pump appears as it would be inside the barrel. #36 is the mandrel; #28 is a special nut; #30 is another special nut, counterbored. #32 is one of many expandable rings. Note that diagonal cuts are together in the upper section, indicating the rings are compressed. #34 is the spacers. #56 is the special tool, the inside surface of which is tapered so that rings and spacers can be easily and safely inserted into the working barrel. Note the lower section of pump and the gaps in the rings and spacers. As they are inserted into the working barrel with the tapered special tool #56, the rings and spacers close as they are compressed. #38 is the special expandable pressure tube. #58 indicates the tool is tapered inside.

Figure 11:
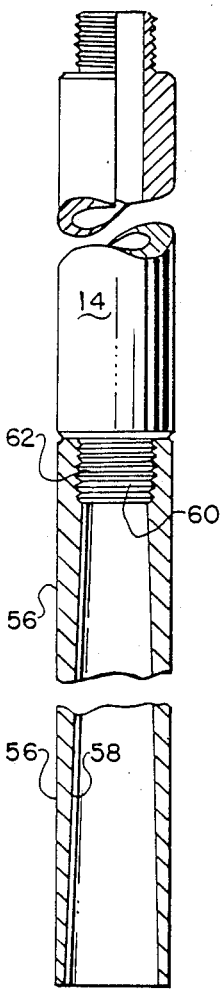
FIG. 11: Side view of an externally threaded working barrel with special internally tapered installation tool, viewed by a cross-sectional of the tool.

FIG. 11 is an externally threaded barrel #14, and the special tool #56 used to facilitate installation of pump inside the barrel. #60 is the external threads of barrel, and #62 is tool internally threaded. #56 is the outer face of the special tool, and #58 is the inner face, indicating the tool is tapered.

Figure 12:
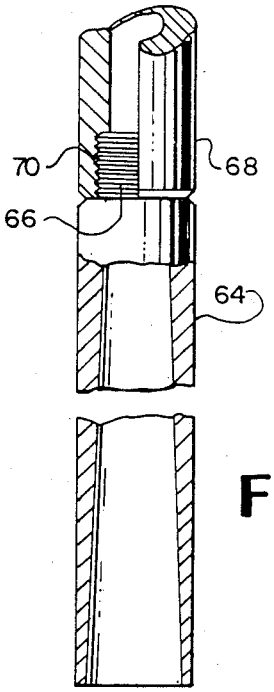
FIG. 12: A working barrel, internally threaded, and special internally tapered tool shown in a cross-sectional view of the tool.

FIG. 12: With reference to the explanation in FIG. 11, this figure shows a working barrel #68, with internal threads, #70. #64 is the special internally tapered tool, with external threads #66.

Respectively, these tools are made in different sizes to accommodate the different sizes of working barrels. They are cylindrical, threaded either internally or external, tapered internally from the end opposite the threads toward the threaded section, and tapered to the dimension of the inside diameter of the preferred working barrel. The taper squeezes the rings and spacer together as the pump passes through the tool.

FIG. 14 is a sectional view of the one-piece expandable tube, 82 is the inside surface of the tube, 83 is the outside surface the circumferentially recessed sections, and 84 is the outside surface of the circumferential protrusions of the tube that makes contact with the inner surface of a working barrel.

Note also the side view in FIG. 13, 81 is the outside surface of the contact portion of the tube 80 and 85 is a recessed portion.

I claim:

1. A reciprocating downhole pump within a working barrel operated by a sucker rod extending between a pumping unit on a ground level and the down hole pump in a well comprising:

a hollow mandrel forming a tubular member with threaded sections on both ends of said hollow mandrel and perforations formed on said mandrel between the threaded sections;

an expandable tube surrounding said hollow mandrel between said threaded sections and covering said perforations, thereby forming a means for communicating hydrostatic pressure existing within said hollow mandrel on an upstroke of said pump to expand said expandable tube;

a plurality of special expandable rings which surround said expandable tube, said expandable tube causing said expandable rings to expand radially with said expandable tube so as to maintain constant contact with an interior surface of said working barrel;

a plurality of expandable spacers also surrounding and expanding with said expandable tube between each of said expandable rings having a significantly smaller outside diameter than said expandable rings, said spacers remaining free of contact with said working barrel so as to form a space between each of said expandable rings to trap fluid in said space thereby acting as a lubricating source;

and a plurality of adjustable retainers fitting onto each of said threaded sections so as to axially secure said plurality of spacers and expandable rings.

2. A reciprocating downhole pump within a working barrel operated by a sucker rod extending between a pumping unit on a ground level and the down hole pump in a well comprising:

a hollow mandrel forming a tubular member with perforations formed on said mandrel;

an expandable tube surrounding said hollow mandrel and covering said perforations, thereby forming a means for communicating hydrostatic pressure existing within said hollow mandrel on an upstroke of said pump to expand said expandable tube;

a plurality of special expandable rings which surround said expandable tube, said expandable tube causing said expandable rings to expand radially with said expandable tube so as to maintain constant contact with an interior surface of said working barrel;

a plurality of expandable spacers also surrounding and expanding with said expandable tube between each of said expandable rings having a significantly smaller outside diameter than said expandable rings, said spacers remaining free of contact with said working barrel so as to form a space between each of said expandable rings to trap fluid in said space thereby acting as a lubricating source;

and means located on each end of said mandrel to axially secure said expandable tube, rings, and spacers onto said mandrel.

3. A piston comprising:

a hollow mandrel forming a tubular member with perforations formed on said mandrel;

an expandable tube surrounding said hollow mandrel and covering said perforations, thereby forming a means for communicating hydrostatic pressure existing within said hollow mandrel on an upstroke of said piston to expand said expandable tube;

a plurality of special expandable rings which surround said expandable tube, said expandable tube causing said expandable rings to expand radially with said expandable tube;

a plurality of expandable spacers also surrounding and expanding with said expandable tube between each of said expandable rings having a significantly smaller outside diameter than said expandable rings, said spacers forming a space between each of said expandable rings to trap fluid in said space thereby acting as a lubricating source;

and means located on each end of said mandrel to axially secure said expandable tube, rings, and spacers onto said mandrel.

4. The device of claim 1 wherein said expandable tube, rings and spacers are integrally formed of the same piece such said spacers are represented by circumferential recessed sections and said rings are represented by circumferential protrusions.

5. The device of claim 2 wherein said expandable tube, rings and spacers are integrally formed of the same piece such said spacers are represented by circumferential recessed sections and said rings are represented by circumferential protrusions.

6. The device of claim 3 wherein said expandable tube, rings and spacers are integrally formed of the same piece such said spacers are represented by circumferential recessed sections and said rings are represented by circumferential protrusions.

* * * * *